US007050971B1

(12) United States Patent
Kaufholz

(10) Patent No.: US 7,050,971 B1
(45) Date of Patent: May 23, 2006

(54) SPEECH RECOGNITION APPARATUS HAVING MULTIPLE AUDIO INPUTS TO CANCEL BACKGROUND NOISE FROM INPUT SPEECH

(75) Inventor: Paul A. P. Kaufholz, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/666,398

(22) Filed: Sep. 20, 2000

(30) Foreign Application Priority Data

Sep. 23, 1999 (EP) ..... 99203122

(51) Int. Cl.
*G10L 21/02* (2006.01)

(52) U.S. Cl. ..... 704/226; 381/71.3

(58) Field of Classification Search ..... 704/226, 704/227, 228; 381/71.3
See application file for complete search history.

(56) References Cited

U.S. PATENT DOCUMENTS

| | | | | |
|---|---|---|---|---|
| 4,912,767 | A * | 3/1990 | Chang | 704/205 |
| 5,033,082 | A * | 7/1991 | Eriksson et al. | 379/406.08 |
| 5,255,326 | A | 10/1993 | Stevenson | 381/71.6 |
| 5,309,378 | A * | 5/1994 | Beierle | 700/280 |
| 5,485,515 | A * | 1/1996 | Allen et al. | 379/391 |
| 5,737,433 | A * | 4/1998 | Gardner | 381/94.7 |
| 5,774,859 | A * | 6/1998 | Houser et al. | 704/275 |
| 6,058,075 | A * | 5/2000 | Bourdelais | 367/103 |
| 6,072,881 | A * | 6/2000 | Linder | 381/94.1 |

FOREIGN PATENT DOCUMENTS

| | | | | |
|---|---|---|---|---|
| WO | WO 98/01956 | * | 1/1998 | 381/94.1 |

* cited by examiner

*Primary Examiner*—Donald L. Storm

(57) ABSTRACT

A speech recognition apparatus including an audio cancellation module is disclosed. The module includes an audio input for receiving an audio signal from a microphone. The module also includes at least two audio inputs for receiving audio signals from respective independent audio sources. The audio cancellation module produces a speech signal by canceling two of the independent audio source signals from the microphone signal. A speech recognizer is used to recognize at least part of the speech signal.

10 Claims, 2 Drawing Sheets

SPEECH RECOGNITION APPARATUS HAVING MULTIPLE AUDIO INPUTS TO CANCEL BACKGROUND NOISE FROM INPUT SPEECH

The invention relates to a speech recognition apparatus including:

an audio cancellation module, including an audio input for receiving an audio signal from a microphone; an audio input for receiving an audio signal from an audio source; the audio cancellation module being operative to produce a speech signal by canceling the audio source signal from the microphone signal; and a speech recognizer for recognizing at least part of the speech signal.

The invention further relates to a consumer electronics system comprising at least two audio source apparatuses, the audio cancellation module and the speech recognizer.

The invention further relates to the audio cancellation module.

U.S. Pat. No. 5,255,326 discloses a consumer electronics system with several audio/video apparatuses connected to a surround sound amplifier for reproduction of the sound. The amplifier has audio inputs for each possible independent audio/video source, such as TV, tape player, disc player and radio. Typically, an audio input is capable of receiving a stereo audio signal. The user selects of which audio source the audio signal is reproduced. This selected signal is processed by a surround sound processor in the amplifier. The processed signal is amplified and reproduced via loudspeakers connected to the amplifier. The processed signal is also passed on to a microprocessor or personal computer. A microphone is used to obtain speech from a user. The microphone signal contains the reproduced audio in addition to the speech. The computer subtracts the processed audio signal from the microphone signal to obtain the speech signal. The speech signal is recognized by a speech recognizer. The recognition outcome is used to control the system.

Recently, recognition of speech has become possible with a reasonable accuracy as long as certain conditions are met. For instance, recognition accuracy drops considerable in the presence of high levels of audio/noise being present in the signal received via the microphone. The known system eliminates the audio contribution produced by the amplifier. In practice, however, most users have more than one apparatus capable of generating sound or noise. For instance, if in the known system the user would be watching the TV and using the amplifier of the TV to reproduce the sound, instead of the external surround sound amplifier, the sound of the TV would not be eliminated by the computer, resulting in a severely degraded recognition.

It is an object of the invention to provide a speech recognition apparatus, a consumer electronics system and an audio cancellation module of the kind set forth which is more flexible in eliminating audio signals which effect the speech recognition.

To meet the object of the invention, the audio cancellation module includes at least two audio inputs for receiving audio signals from respective independent audio sources; and in that the audio cancellation modules is operative to produce the speech signal by canceling at least two of the independent audio source signals from the microphone signal.

In this way the speech recognition apparatus is no longer strictly coupled to one sound (audio/noise) producing apparatus, like a surround sound amplifier, but can work with any desired number of sound producing apparatuses. For instance, the recognition apparatus may be able to work for a separate audio amplifier (e.g. for reproducing an audio signal from a radio or CD), a TV amplifier, an amplifier in a hands-free telephone, etc. In addition, separate microphones may be used to obtain disturbing sound (e.g. noise) signals produced by devices, such as ventilators (e.g. in a living room, or in a PC), vacuum cleaners, traffic. This approach is preferably also used in an open-office design, where multiple users may be speaking simultaneously (e.g. dictating on the PC or having a telephone conversation). The microphone signal(s) of those 'disturbing' voices are then fed into the speech recognition apparatus and eliminated. In addition to voices of other users, such microphones may also record other sounds, e.g. sound generated by those PCs like the Windows sound signals or sound generated by programs such as games. Preferably, such microphones are placed near the source of the disturbance to obtain the disturbance as 'clean' as possible. Alternatively, microphone arrays may be used. The microphone signals may be transferred to the speech recognition apparatus in any suitable way. For instance, using separate wires, using wireless transmission (e.g. RF), or via the mains wiring.

The speech recognition apparatus may be used for speech-to-text conversion (dictation). This provides the possibility for the user to listen to music while at the same time dictating a text. It also allows elimination of noise, for instance like generated by fans or discs in the PC used for the recognition.

In a preferred embodiment as defined in the dependent claim 2, the speech recognition apparatus is used for voice control of apparatuses including apparatuses other than the recognition apparatus itself. Those apparatuses include preferably audio/video equipment (e.g. TV, disc players/recorders, tape players/recorders, audio tuners, set top boxes, etc.) as well as other devices which can be found in a home network, such as computer related products (e.g. printers, scanners, etc.), security products, domestic appliances, and temperature control equipment. Suitable means for communicating a control message to such an apparatus are well known.

According to the measure of the dependent claim 3, the apparatuses are controlled using remote control messages. In this way, apparatuses can be voice controlled in a simple and cost-effective way, without the need to introduce speech recognition in all controlled apparatuses. It also allows control of existing apparatuses which do not have voice control capabilities. Preferably, the speech recognition apparatus is capable of controlling many different apparatuses in a manner known from universal pre-programmed or learning remote controls, where the activation of a command is given via voice instead of a keystroke. This enables control of many different types and makes of apparatuses.

As defined in the measure of the dependent claim 4, an audio communication network is used for receiving audio from an external audio source. Such a network may be wired or wireless. It may be based on point-to-point connections. Preferably, a serial bus is used, allowing for cost-effective connection of several sources to the speech recognition apparatus. For dictation in a predominant PC environment, preferably USB or a similar network is used. For voice control in a predominant audio/video environment, preferably IEEE 1394 is used.

As defined in the measure of the dependent claim 5, a same communication network is used for transferring audio to the speech recognition apparatus as issuing command messages from the speech recognition apparatuses to other apparatuses in the system. Preferably, a network based on IEEE 1394 is used. IEEE 1394 supports several independent isochronous data streams, which can be used for transporting audio. The audio may be broadcast via the network or send directly to the speech recognition apparatus. In addition, IEEE 1394 can transfer command messages, which may be according to the HAVi protocol.

As defined in the measure of the dependent claim 6, the speech recognition apparatus does not need to be able to reproduce the audio signal(s) supplied to it. As such, more flexibility is achieved. For instance, the speech recognition apparatus can be a stand-alone control device for controlling the other apparatuses in the system. In such a configuration the apparatus may not be able to produce any audio output, possibly with the exception of audible feedback to the user with respect to the operation of the apparatus or the control of the system. As such the audio input for receiving audio for external sources are exclusively for cancellation purposes. For example, the speech recognition apparatus may advantageously be used for integrating stand-alone devices, such as a TV, a DVD player and an audio system, into a Home Cinema system. In such an integrated system, the speech recognition apparatus may include additional control intelligence to integrate the functionalities of the individual devices into a system behavior. For instance, a voice command like "DVD play" may result in the speech recognition apparatus not only activating the DVD player, but also the TV and amplifier and establishing the desired signal connections.

The apparatus may also be integrated into a TV, where in many systems it will be sufficient that the TV has one extra input for receiving an audio output signal representing the audio being produced by the audio system. The TV will normally not be used for reproducing any source signal from the audio system. So, the main function of receiving this signal is to be able to cancel it from the microphone signal. It may even be impossible to reproduce such an audio signal. By being able to cancel audio from an external source, it becomes possible that, for instance, a user watches Teletext or WebTV-like functions on the TV and controls such functions via voice while listening to a CD (external source, part of the audio system). Similarly, a user may be able to control the CD via a speech control unit in the TV.

To meet the object of the invention, a consumer electronics system includes:

at least two audio source apparatuses;

an audio cancellation module, including:

an audio input for receiving an audio signal from a microphone; and at least two audio inputs for receiving independent audio signals from respective ones of the audio source apparatuses;

the audio cancellation module being operative to produce a speech signal by canceling at least two of the independent audio source signals from the microphone signal; and a speech recognizer for recognizing at least part of the speech signal.

To meet the object of the invention, an audio cancellation module includes:

an audio input for receiving an audio signal from a microphone;

at least two audio inputs for receiving audio signals from respective independent audio sources;

the audio cancellation module being operative to produce a speech signal by canceling at least two of the independent audio source signals from the microphone signal.

These and other aspects of the invention will be apparent from and elucidated with reference to the embodiments shown in the drawings.

Figure 1:
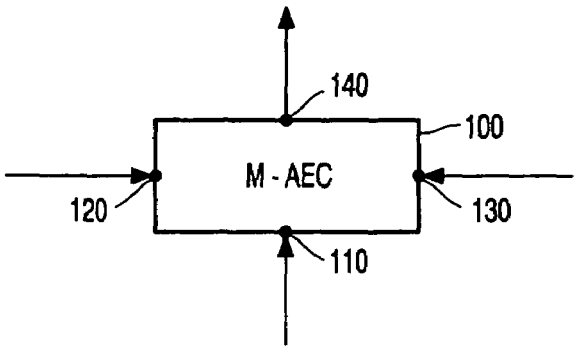
FIG. 1 shows a block diagram of the audio cancellation module 100 according to the invention.

FIG. 1 shows a block diagram of the audio cancellation module 100 according to the invention. The module 100 includes an audio input 110 for receiving a signal 110 from a microphone. Microphones suitable for speech recognition purposes are well known. Usually, the microphone provides a mono audio signal. For dictation, preferably a head-worn microphone is used, or a microphone placed relatively near the user (e.g. at half a meter distance). For voice control, the microphone may be placed much further away (e.g. at several meters distance). The module 100 includes several audio inputs for receiving audio signals from respective independent audio sources. Shown are two audio inputs 120 and 130. An audio input is used for receiving all related audio signals of one source. Normally, an audio signal is a stereo signal, in which case the input may have two separate input connectors for receiving the stereo signal. A surround sound encoded signal may even have 5 or 6 separate connectors (e.g. front left, front right, rear left, rear right, center, sub-woofer). For the purpose of this invention, such a signal is regarded as one signal. The audio cancellation module 100 is operative to produce a speech signal by canceling at least two of the independent audio source signals from the microphone signal. In itself cancellation of an audio signal is well known and usually referred to as audio echo cancellation. It may, for instance, involve subtracting the audio signal from the microphone signal. The time delay and amplitude of the audio signal as present in the microphone signal can be estimated with respect to audio signal which is received via one of the audio inputs. Such an estimation may, for instance, be performed using well known statistical correlation techniques. The audio cancellation module according to the invention may perform the cancellation of several audio signals by sequentially canceling each signal in turn. So, the module 100 may include several cancellation units in sequence, where the first unit cancels a first audio signal from the microphone signal, the second unit cancels a second audio signal from the output of the first unit, etc. Particularly since all cancellation units are located in the same module, this enables easy compensation of delays introduced in each cancellation unit. For instance, the microphone input to the cancellation unit which is number N in the sequence is delayed (via buffering) for (N−1) times the delay in the cancellation unit. Preferably, the module 100 cancels several signals in one integrated process. A preferred way of canceling multiple signals is described in the non pre-published patent application number EP 9920206.3 (PHN 17514); details of this algorithm are hereby included by reference.

Figure 2:
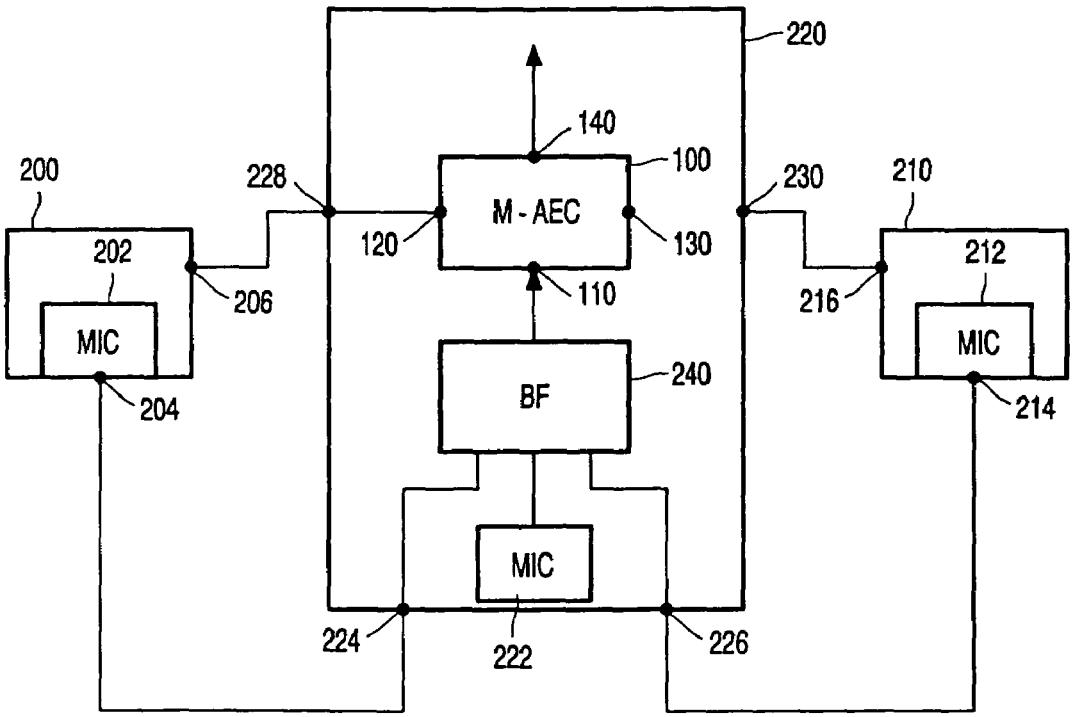
FIG. 2 illustrates using a plurality of microphones.

In an embodiment as shown in FIG. 2, instead of using one microphone, the possibility of obtaining input from separate microphones is offered. The microphones may be located in a conventional microphone array, where each microphone covers a different direction. Preferably, the audio cancellation module 100 is used in a consumer electronics systems, where several of the apparatuses in the system have a microphone. FIG. 2 shows such a system. In the system, an audio set 200 has a built-in microphone 202 (or microphone input) and a microphone signal output 204.

Similarly, a TV 210 has a built-in microphone 212 (or microphone input) and a microphone signal output 214. The audio cancellation module 100 is located in a further apparatus 220 of the system. In the example, this apparatus 220 also has a built-in microphone 222 (or microphone input). The apparatus 220 has two microphone inputs 224 and 226 for receiving the microphone signals from the respective outputs 204 and 214. All microphone signals (in the example two external microphone signals and one internal microphone signal) are supplied to a beam former 240. The beam former combines the microphone signals, resulting in a higher performance and resolution of the resulting microphone signal. The beam former may also select or even 'track' an audio source. Typically, the loudest source signal is identified (usually a person speaking) and this source signal is tracked among the various microphone input signals. The output signal of the beam former is provided to the microphone input 110 of the audio cancellation unit 100. Also shown are two audio inputs 228 and 230 of the apparatus 220 which serve to receive audio signal from respective external apparatuses. In the shown system, the external audio inputs 228 and 230 are connected to the respective audio line outputs 206 and 216 of the audio set 200 and the TV 210. Within the apparatus 220, the external audio inputs 228 and 230 are connected to the respective audio inputs 120 and 130 of the audio cancellation module 100.

Figure 3:
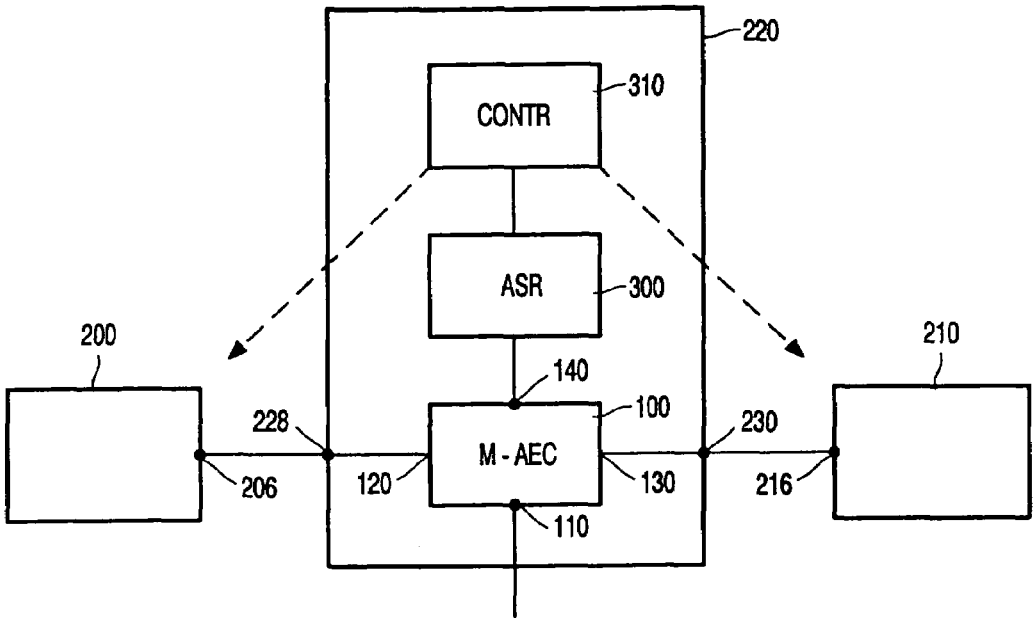
FIG. 3 shows an embodiment incorporating a speech recognizer.

FIG. 3 shows a further embodiment wherein the speech signal 140 produced by the audio cancellation module 100 is supplied to a speech recognizer 300. The speech recognizer is preferably located in the same apparatus as the module 100. If desired, the recognizer 300 may also be located in a separate apparatus. For instance, a separate audio cancellation module may be placed in several rooms, where only one central recognizer is used which can recognize speech received from any of the modules. The recognition result may be used for several applications, such as dictation (speech-to-text), control or information retrieval. Shown is a controller 310, which in response to a recognized command, performs a control action. The control action may be limited to operations of the apparatus in which the controller 310 is located. Particularly if the control unit is in an apparatus forming part of a larger system, as shown in FIG. 3, preferably the control unit also controls operations of the other apparatuses. To this end, the controller can issue command message(s), shown as a dotted line, to other apparatus in the system via a control communication network. Such a network may be formed in various ways. For instance, dedicated control links may be used to connect the apparatus 220 which holds the controller 310 to the other apparatuses 200 and 210. Such a link may be effective via one or more control signal wires. To achieve a simple control link, it is preferred to issue a control message in the form of a remote control message, which is typically transmitted via infrared signals. In principle, a uni-directional remote control system may be used capable of transferring messages from the controlling apparatus 220 to the other apparatuses. For more sophisticated control, also a bi-directional remote control system may be used. In itself, remote control systems are well known and will not be described in full detail. Preferably, the controller 310 can be 'programmed' by the user, such that the controller 310 is capable of controlling the apparatuses in the system according to the specific remote control system and messages of these apparatuses. To this end, the controller incorporates logic similar to that of a universal pre-programmed or learning remote control. Preferably, the user can specify a voice command for the specific command messages to be issued by the controller 310. This may, for instance, be achieved by letting the user select for a given control message (e.g. a VCR instruction for playing a tape) from a predetermined list of voice commands (e.g. 'play' or 'start'). Such predetermined voice commands can be recognized using speaker-independent recognition. Alternatively, the user may specify his own voice command, in which case preferably speaker-dependent recognition is used. In itself, speech recognition and specifying voice commands is known.

Figure 4:
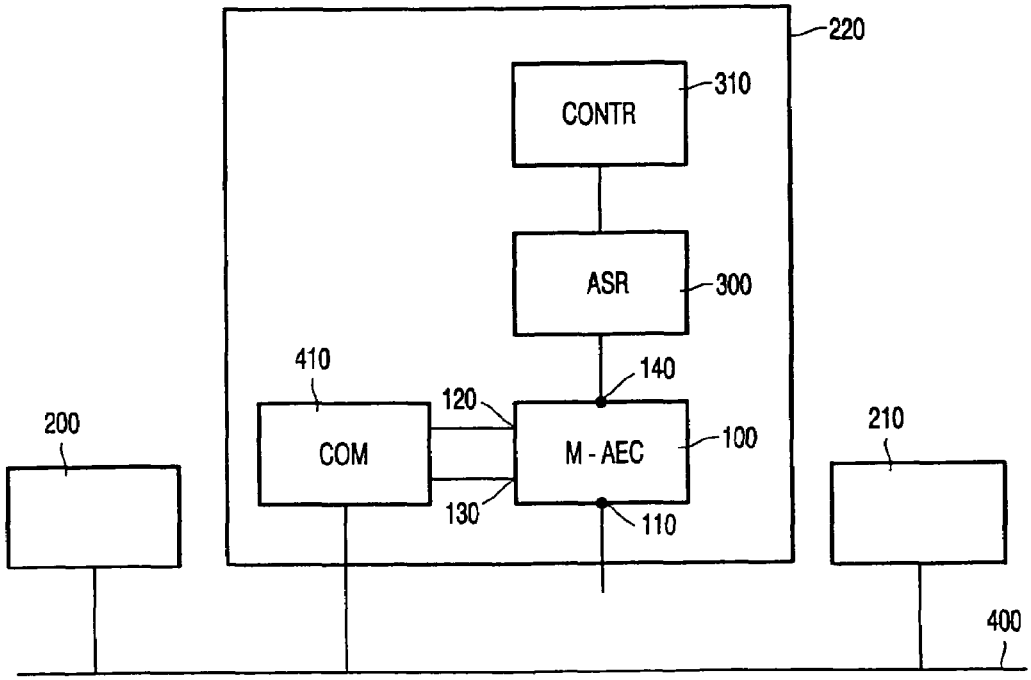
FIG. 4 shows a system according to the invention.

In the embodiment shown in FIG. 4, the apparatuses 200, 210 and 220 are connected via a communication network 400. This network may be used to transfer various types of data, such as:

audio signals (typically in a digitized form, transferred as isochronous data streams), microphone signal (typically treated as an audio signal for the transfer), control instructions/messages.

Preferably, the same network provides several or even all of these forms of transport. In the example shown in FIG. 4, the audio signals and the control signals are transferred via the network. To this end, the speech recognition apparatus 220 includes a communication interface 410, which in itself is well-known, for retrieving the audio signals from the data transmitted via the network and supplying the audio signals to the audio cancellation module. The command messages generated by the controller 310 are transmitted via the same communication interface 410.

Voice control of a CE apparatus, like audio/video equipment or domestic appliances, is usually difficult in that frequently it is not clear to the user which voice commands can be used. Particularly, in a large or advanced system the number of controllable functions may be large and may vary. Whereas a user for voice control of a PC can use help facilities to get an overview of all possible voice commands, the user interface possibilities of CE equipment tend to be more restricted. To overcome these problems, it is preferred that the controller is operative to supply the user with information on which commands can be spoken at that moment. In this so-called feed-forward, the list of commands is limited to those commands which can be executed as determined by the state of the system or the apparatus involved or by a given control hierarchy/sequence or by the context. As an example, if a centralized controller is used for controlling some or all apparatuses in the system, an initial feed-forward list could contain only device selection commands (such as 'TV', 'VCR', 'CD'), that inform the controller which apparatus the user intends to control. Next, the feed-forward list would contain only those commands of the selected apparatus which can be executed by that apparatus in view of a control hierarchy/sequence or the state of the selected apparatus.

With respect to the control hierarchy/sequence, nowadays some apparatuses do not provide direct access to all functions which can be controlled at that moment. Typically, advanced settings of audio, video and tuning in a TV can only take place via hierarchical menus. At a top menu the user selects the group of functions to be controlled. At the second level, usually the user can control the specific functions of the selected group. Sometimes even more menu levels are used. For a voice-controlled apparatus, it is preferred to give direct access to as many functions as reasonably possible. According to the invention, for highly functional apparatuses also a hierarchical approach is used for voice control. This limits the number of possible voice commands (to only those at the presently selected group of voice commands), increasing the reliability of the recognition and at the same time enabling effective feed-forward of the then speakable voice commands.

In addition to or instead of using a prescribed hierarchy/sequence of voice commands, the list of speakable commands can also be limited by only allowing those voice commands which can be executed in view of the state of the involved apparatus or the state of the system. For instance, if a CD player contains no disk, the feed forward list may only contain the commands "eject" and "standby", whereas a larger list of commands will be possible if a disc is loaded. In a further embodiment according to the invention, the feed-forward list is not only determined by a fixed state behavior of the apparatus, but also by variable context information. For instance, if a TV displays information, e.g. retrieved from the Internet or an Electronic Programming Guide (EPG), then the information itself may influence which voice commands are possible. For an Internet page, the links may be speakable; for an EPG page the programs may be selectable for viewing or recording. Also browsing commands may be speakable. Another example where the content may determine the feed forward list is the situation wherein the functionality of a disc content varies. For instance, if a disc is loaded with only one index, the feed-word list may not contain index selection commands. If the disc contains eight tracks, only the first eight tracks can be selected via speech. Similarly, if a copy protected tape is loaded in a VCR, the "record" command can not be used and need not be in the feed-forward list.

The controller may be pre-programmed with information regarding the control hierarchy of an apparatus. Particularly if the controller is part of the apparatus which is being controlled, the controller can easily administrate which part of the hierarchy is active and as such load or compile a feed-forward list. If the controller is not part of the apparatus being controlled, preferably the controller obtains relevant information from the product being controlled. Such information may be obtained via a communication network. The information may be obtained in various ways. For example, the controller could obtain the entire control hierarchy from the involved apparatus. The controller itself can then administrate which part of the hierarchy is active, e.g. based on input of the user (via voice commands or remote control). The controller can also check which part is active at the moment of receiving input from the user. Alternatively, the apparatus being controlled can keep the controller informed of its current state. Communication protocols for performing status monitoring or automatic status updating are well known. Instead of the controller obtaining the entire control hierarchy/sequence, the controller may also retrieve only the part of command set formed by the then active part of the control hierarchy or allowed by the then active state of the apparatus.

The actual presenting of the feed-forward list may be done in any suitable form, e.g. by visually or audibly presenting the speakable commands.

What is claimed is:

1. A speech recognition apparatus comprising:

an audio cancellation module, including:

an audio input for receiving an audio signal that includes a speech signal and a plurality of different background noises;

at least two additional audio inputs for receiving at least two audio source signals, respectively, from independent audio sources that primarily do not include said speech signal, the at least two audio source signals contributing to the plurality of different background noises of the audio signal and are within a proximity of the sensitivity range of a microphone for capturing said speech signal and each respective audio input arranged within a proximity of a respective audio source, wherein the audio cancellation module is operative to cancel the at least two audio source signals from the audio signal received, substantially sequential, to leave a remainder of the audio signal received that comprises primarily the speech signal; and a speech recognizer for recognizing at least part of the speech signal.

2. A speech recognition apparatus as claimed in claim 1, further comprising:

a controller for issuing at least one command message to a further apparatus via a control communication network in response to a spoken instruction from a user that is recognized by the speech recognizer.

3. A speech recognition apparatus as claimed in claim 2, wherein the controller is operative to issue the at least one command message according to remote control messages associated with the further apparatus.

4. A speech recognition apparatus as claimed in claim 1, wherein at least one of the two audio source signals is received via an audio communication network from an audio source unit that is external to the speech recognition apparatus.

5. A speech recognition apparatus as claimed in claim 1, wherein the speech recognition apparatus includes at least one audio input for receiving an external audio source signal from an audio source unit that is external to the speech recognition apparatus; the audio source signal from the audio source unit that is external to the speech recognition apparatus being received substantially for the purpose of canceling the external audio source signal from the audio signal.

6. A consumer electronics system comprising:

at least two independent audio source apparatuses;

an audio cancellation module, including:

an audio input for receiving an audio signal that includes a speech signal and a plurality of different background noises; and at least two additional audio inputs for receiving, respectively, independent audio source signals from respective ones of the audio source apparatuses, the at least two independent audio source signals contributing to the audio signal;

the audio cancellation module being operative to cancel the at least two independent audio source signals from the audio signal received, substantially sequential, to leave a remainder of the audio signal received that comprises primarily the speech signal; and a speech recognizer for recognizing at least part of the speech signal that remains.

7. A system as claimed in claim 6, further comprising a control unit for, in response to a spoken instruction from a user that is recognized by the speech recognizer, issuing at least one command message to an apparatus in the system via a communication network.

8. A system as claimed in claim 7, wherein at least one of the independent audio source signals is received via the communication network from the associated audio source apparatus.

9. A system as claimed in claim 8, wherein the audio cancellation module is located in an apparatus of the system, where the apparatus includes at least one audio input for receiving an audio source signal from an audio source apparatus external to the apparatus; the audio signal being received substantially for the purpose of canceling this audio signal from the audio signal.

10. An audio cancellation module, comprising:

an audio input for receiving an audio signal that includes a speech signal and a plurality of different background noises, said audio signal including an indication of a highest signal source from among said speech signal and each of said plurality of different background noises; and at least two additional audio inputs for receiving audio source signals, respectively, from respective independent audio sources, the at least two audio source signals contributing to the plurality of different background noises included in the received audio signal;

the audio cancellation module being operative to produce a signal by canceling from the audio signal received those signals not indicated to be the highest signal source.

* * * * *